US010259111B2

(12) United States Patent
Herr et al.

(10) Patent No.: US 10,259,111 B2
(45) Date of Patent: Apr. 16, 2019

(54) TOOL ATTACHMENT FOR A HAND-HELD POWER TOOL

(71) Applicant: ROBERT BOSCH GMBH, Stuttgart (DE)

(72) Inventors: Tobias Herr, Stuttgart (DE); Dietmar Saur, Moessingen (DE); Joerg Welke, Ettlingen-Schoellbronn (DE); Heiko Roehm, Stuttgart (DE); Jens Blum, Filderstadt (DE)

(73) Assignee: ROBERT BOSCH GMBH, Stuttgart (DE)

( * ) Notice: Subject to any disclaimer, the term of this patent is extended or adjusted under 35 U.S.C. 154(b) by 753 days.

(21) Appl. No.: 14/781,876

(22) PCT Filed: Mar. 24, 2014

(86) PCT No.: PCT/EP2014/056027
§ 371 (c)(1),
(2) Date: Oct. 1, 2015

(87) PCT Pub. No.: WO2014/161752
PCT Pub. Date: Oct. 9, 2015

(65) Prior Publication Data

US 2016/0346911 A1 Dec. 1, 2016

(30) Foreign Application Priority Data

| | | |
|---|---|---|
| Apr. 3, 2013 | (DE) | 10 2013 205 833 |
| Sep. 12, 2013 | (DE) | 10 2013 218 289 |
| Mar. 25, 2014 | (DE) | 10 2014 205 555 |

(51) Int. Cl.
*B25F 3/00* (2006.01)
*B25D 9/06* (2006.01)

(52) U.S. Cl.
CPC ..... *B25F 3/00* (2013.01); *B25D 9/06* (2013.01); *B25D 2250/051* (2013.01)

(58) Field of Classification Search
CPC ..... B25F 3/00; B25D 9/06; B25D 2250/051
(Continued)

(56) References Cited

U.S. PATENT DOCUMENTS 4,098,354 A 7/1978 Alcenius
5,366,025 A * 11/1994 Dutschk ..... B25D 11/005 173/109

(Continued)

FOREIGN PATENT DOCUMENTS

CN 1236338 A 11/1999
CN 201338261 Y 11/2009

(Continued)

OTHER PUBLICATIONS

International Search Report for PCT/EP2014/056027, dated Jun. 17, 2014.

*Primary Examiner* — Michelle Lopez
(74) *Attorney, Agent, or Firm* — Norton Rose Fulbright US LLP; Gerard Messina

(57) ABSTRACT

A tool attachment for a handheld power tool that has a housing having a fastening interface includes: an attachment housing on which there is situated a locking unit for locking the tool attachment on the fastening interface of the hand-held power tool; a tool receptacle for accommodating an insertion tool; and a hammer mechanism situated in the attachment housing, which hammer mechanism is configured to apply an impact in the axial direction of the tool receptacle on the insertion tool, during hammer operation of the tool attachment.

21 Claims, 7 Drawing Sheets

(58) Field of Classification Search
USPC ..... 173/90, 93.5, 48
See application file for complete search history.

(56) References Cited

U.S. PATENT DOCUMENTS

| | | | | |
|---|---|---|---|---|
| 5,437,465 | A * | 8/1995 | Vogele | B23Q 3/12 279/22 |
| 5,511,912 | A | 4/1996 | Ellerbrock | |
| 7,506,693 | B2 * | 3/2009 | Stirm | B25D 11/005 173/104 |
| 2011/0303430 | A1 * | 12/2011 | Hartmann | B25D 17/06 173/112 |

FOREIGN PATENT DOCUMENTS

| | | |
|---|---|---|
| CN | 202607626 U | 12/2012 |
| DE | 44 45 597 | 6/1996 |
| GB | 2 430 907 | 4/2007 |
| WO | WO 2008/068100 | 6/2008 |
| WO | 2012055669 A1 | 5/2012 |

* cited by examiner

TOOL ATTACHMENT FOR A HAND-HELD POWER TOOL

BACKGROUND OF THE INVENTION

1. Field of the Invention

The present invention relates to a tool attachment for a handheld power tool, having a housing that has a fastening interface, having an attachment housing on which a locking unit is situated for locking the tool attachment to the fastening interface of the handheld power tool, and a tool receptacle that accommodates an insertion tool.

2. Description of the Related Art

From published international patent application document WO 2008/068100 A1, a tool attachment provided with a tool receptacle is known that has a locking unit for locking to a fastening interface of a handheld power tool such as a screwdriver, drill, or screw driller. The locking unit is used, in an unlocked state, to enable mounting or removal of the tool attachment to or from the handheld power tool, and in a locked state is used to lock the tool attachment to the handheld power tool for operation.

A disadvantage of the existing art is that such a tool attachment has only limited suitability, or is not suitable at all, for drilling in hard stone or concrete.

BRIEF SUMMARY OF THE INVENTION

An object of the present invention is therefore to provide a new tool attachment that can also be used for drilling in hard stone or concrete.

This object is achieved by a tool attachment for a handheld power tool that has a housing having a fastening interface having an attachment housing on which a locking unit is situated for locking the tool attachment on the fastening interface of the handheld power tool, and a tool receptacle that accommodates an insertion tool. In the attachment housing there is situated a hammer mechanism that is fashioned to charge the insertion tool with impacts executed in the axial direction of the handheld power tool during hammer operation of the tool attachment. Here, either the tool receptacle or the insertion tool can be charged with the impacts.

The present invention thus makes it possible to provide a tool attachment that is also suitable for drilling in hard stone or concrete, due to the hammer mechanism acting in the axial direction of an allocated insertion tool.

According to a specific embodiment, the hammer mechanism is fashioned as a pneumatic hammer mechanism.

In this way, the provision of a tool attachment with an operationally safe and reliable hammer mechanism can be enabled.

The hammer mechanism preferably has a beater that during operation of the tool attachment is driven by an allocated piston so as to impact against an impact bolt.

In this way, the provision of a stable and robust hammer mechanism can be enabled.

Preferably, the impact bolt is connected to a driven element allocated to the tool receptacle.

Thus, axial impacts produced by the hammer mechanism can easily be transmitted to the allocated insertion tool via the tool receptacle.

According to a specific embodiment, the hammer mechanism is fashioned as a mechanical hammer mechanism.

The present invention thus enables the provision of a tool attachment having a hammer mechanism that has a comparatively uncomplicated and space-saving design.

Preferably, the hammer mechanism has a drive element that is situated coaxially to the tool receptacle.

The present invention thus enables the provision of a compact hammer mechanism having reduced spatial measurements.

Preferably, the tool receptacle has a driven spindle that is rotatable about an associated axis of rotation, the axis of rotation coinciding with a drive axis of the hammer mechanism.

Thus, the provision is enabled of an uncomplicated, precise, and user-friendly hammer mechanism.

The hammer mechanism is preferably fashioned for the immediate impact driving of a driven element allocated to the tool receptacle during hammer operation of the tool attachment, the driven element being fashioned to immediately transmit corresponding impact impulses immediately to the insertion tool. According to a specific embodiment, the driven element is formed by the driven spindle of the tool receptacle.

In this way, a stable and robust hammer mechanism can be provided in which, in a simple manner, an impact energy of more than 0.6 J can be produced, so that holes can be drilled for example even in concrete using the hammer mechanism.

Preferably, the hammer mechanism has a hammer body spring-loaded with a spring element, coupled to an associated spring tension element via a ball guide.

The present invention thus enables the provision of a hammer mechanism having a reliable and uncomplicated design.

According to a specific embodiment, the hammer mechanism has an engaging clutch that can be actuated in order to activate the hammer operation of the hammer mechanism.

The present invention thus enables the provision of a hammer mechanism in which a corresponding hammer operation can easily be activated.

Preferably, the engaging clutch is fashioned to enable, when there is an actuation, a driving of the spring tension element for the tension and release of the spring element.

In this way, a safe and reliable activation of the hammer operation of the hammer mechanism can be enabled.

According to a specific embodiment, a gear mechanism is situated in the attachment housing.

In this way, a production of an impact force of the hammer mechanism required for drilling in hard stone or concrete can easily be ensured.

The gear mechanism is preferably fashioned as a step-up transmission, in such a way that through the step-up transmission a rotational speed for driving the hammer mechanism is increased relative to a rotational speed of a driven element. The step-up transmission is in particular fashioned as a single-stage planetary gear. The step-up transmission is in particular fashioned in such a way that it can be activated in hammer operation of the hammer mechanism. The step-up transmission is in particular coupled to the engaging clutch. The coupling of the step-up transmission and the engaging clutch preferably takes place in such a way that when there is an activation of the engaging clutch the step-up transmission is also activated.

According to a specific embodiment, the tool receptacle is fashioned to accommodate SDS-plus and/or SDS-quick insertion tools.

The present invention thus enables the provision of a tool attachment that can be used with a large number of different types of insertion tools, and can thus be used in many different areas of use, and in many different working conditions.

Preferably, the tool receptacle is fashioned to accept round-shaft insertion tools and/or hex insertion tools.

In this way, the possible areas of use and working conditions in which the tool attachment can be used can be further expanded.

Preferably, the tool attachment is fashioned to be driven by the handheld power tool with a positive fit. For this purpose, the tool attachment has a drive element that can be fashioned for example as a drive shaft. The drive element has a free end on which there is fashioned a polygonal entraining contour. The polygonal entraining contour is provided to be accepted in a tool receptacle of a handheld machine tool, and to be driven rotationally by the tool receptacle. The tool receptacle of the handheld power tool has for this purpose a polygonal interior receptacle corresponding to the polygonal entraining contour.

In this way, an uncomplicated and stable driving of the tool attachment can be enabled.

The problem described above is also solved by a tool system having a handheld power tool that has a housing having a fastening interface and having a tool attachment that has an attachment housing on which there is situated a locking unit for locking the tool attachment to the fastening interface of the handheld power tool and a tool receptacle that accommodates an insertion tool. In the attachment housing there is situated a hammer mechanism that is fashioned to charge the insertion tool, during hammer operation of the tool attachment, with impacts executed in the axial direction of the tool receptacle.

The present invention thus enables the provision of a tool system having a handheld power tool and a tool attachment that, due to the hammer mechanism acting in the axial direction of an associated insertion tool, is also suitable for drilling in hard stone or concrete.

The handheld power tool is preferably fashioned as a battery-operated driller screw or battery-operated screwdriver.

Thus, handheld power tools for drilling in hard stone or concrete can be equipped with the tool attachment according to the present invention that, without the tool attachment, would not be suitable for this purpose, so that their areas of use and applicability can easily be expanded or improved.

Preferably, the tool attachment is fashioned so as to be driven with a positive fit by the handheld power tool.

In this way, an uncomplicated and stable drive of the tool attachment can be enabled.

Preferably, the handheld power tool has a drive spindle, and the tool receptacle of the tool attachment has a driven spindle, the drive spindle and the driven spindle having a common axis of rotation after a fastening of the tool attachment on the handheld power tool.

In this way, the provision of an uncomplicated, precise, and user-friendly tool system can be enabled.

DETAILED DESCRIPTION OF THE INVENTION

Figure 1:
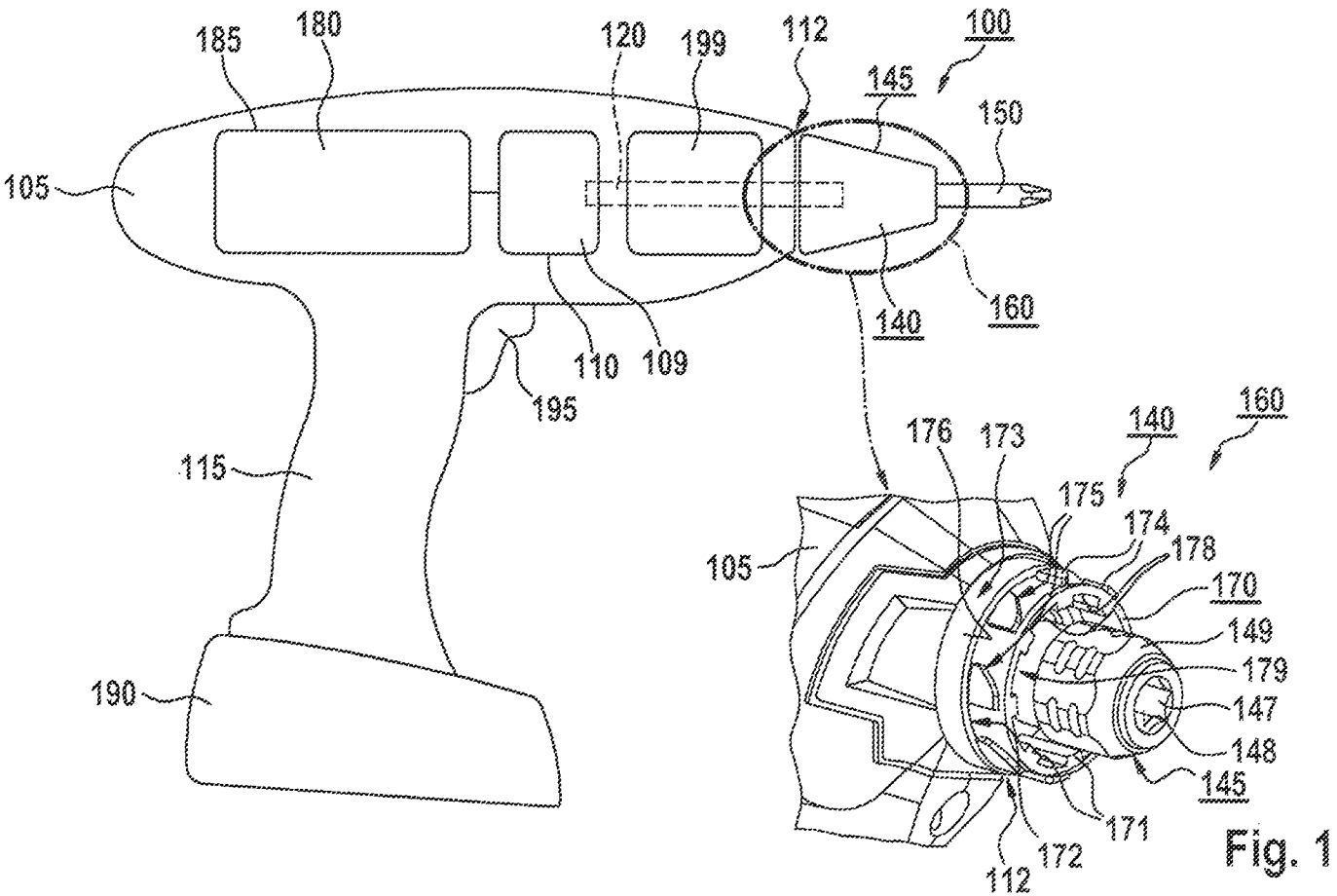
FIG. 1 shows a schematic view of a handheld power tool having a tool receptacle and a fastening interface according to a first specific embodiment.

FIG. 1 shows an example of a handheld power tool 100 that has a tool housing 105 having a handle 115, as well as an enlarged detail 160 of power tool 100. According to a specific embodiment, handheld power tool 100 can be connected mechanically and electrically to a battery pack 190 for power supply independent of the power grid. In FIG. 1, handheld power tool 100 is fashioned, as an example, as a battery-driven screw driller. However, it is to be noted that the present invention is not limited to battery-driven screw drillers, but rather can be used in various types of handheld power tools in which a tool is set into rotation, regardless of whether the handheld power tool can be operated connected to the power grid or independent of the power grid using battery pack 190, e.g. in the case of a screwdriver or battery-driven screwdriver, etc.

In tool housing 105 there are preferably situated at least one electrical drive motor 180, supplied with power by a battery pack 190, and a gear mechanism 109. Drive motor 180 can for example be switched on and off via a manual switch 195, and can be any type of motor, e.g. an electrically commutated motor or a direct-current motor. Gear mechanism 109 can for example be fashioned as a step-down gearing, realized for example with a planetary gearing fashioned with various planetary stages, to which a torque clutch 199 is optionally allocated. The functioning and design of a suitable drive motor and of a suitable gear mechanism, as well as a suitable torque clutch, and their manner of functioning, are adequately known to those skilled in the art, so that illustration and detailed description thereof is omitted here in the interest of brevity of the description and simplicity of the drawings.

According to the illustration, gear mechanism 109 is situated in a gear mechanism housing 110, and drive motor 180 is situated in a motor housing 185, gear mechanism housing 110 and motor housing 185 being situated for example in tool housing 105. Drive motor 180 is connected to a drive shaft 120, for example a drive spindle, via gear mechanism 109. During operation of handheld power tool 100, motor 180 rotationally drives drive shaft 120 via gear mechanism 109.

According to a specific embodiment, handheld power tool 100 has an allocated tool receptacle 140 that accepts an insertion tool 150 that for example has a bit holder 145. This tool receptacle 140 can be integrally formed on the drive shaft, which can be driven by drive motor 180 via gear mechanism 109, or can be connected thereto as an attachment.

In the illustration, bit holder 145 has an actuating sleeve 149 and a polygonal inner receptacle 147, in particular a hexagonal inner receptacle, that receives a so-called hex drill or screwdriver bit. Suitable hex drills and screwdriver bits are tools that have a shaft having a cross-section that is hexagonal at least in some sections, provided with an annular groove in the case of hex drills. In addition, bit holder 145 can also, or alternatively, be fashioned to accommodate a so-called SDS-quick mini-drill tool. SDS-quick mini-drill tools suitable for this purpose are drill tools that have a substantially cylindrical shaft having two rotational entraining pegs that stand out parallel to the longitudinal axis of the shaft, each having a locking opening. However, it is to be noted that hexagonal inner receptacle 147 can, in addition or alternatively, also be fashioned to receive other types of insertion tools. For example, hexagonal inner receptacle 147 can also be fashioned to accept SDS-plus insertion tools. Examples of insertion tools, and the design and functioning of a suitable bit holder, are adequately known to those skilled in the art, for example from German utility model document DE 20 2007 010 699 U1, whose disclosure is explicitly incorporated into the present description, so that detailed description of these components can be omitted here in the interest of brevity of the description.

According to a specific embodiment, handheld power tool 100, or tool receptacle 140, is allocated a fastening interface 170 that, in the illustration, is situated in the region of an end face 112 of tool housing so as to be axially and radially immobile. This interface is fashioned for example as a sleeve, and is therefore also referred to as a fastening sleeve in the following. However, it is to be noted that fastening sleeve 170 is fashioned as a separate component only as an example, and, alternatively, can also be fashioned in one piece with tool housing 105 and/or gear mechanism housing 110.

Fastening sleeve 170 is used as a locking and centering system for an allocated tool attachment (300 in FIG. 3), and sheaths, at least in some sections, bit holder 145 with a specified radial distance, in order to enable an axial displacement of actuating sleeve 149 of bit holder 145 inside fastening sleeve 170. On inner circumference 179 of fastening sleeve 170 there are provided web-type raised parts, at a distance from one another in the illustration, that extend in the longitudinal direction of fastening sleeve 170 and are oriented radially inward, of which only two raised parts are identified with reference character 171, in the interest of clarity of the drawing. Between these web-type raised parts, in the illustration groove-type openings are fashioned, of which, for clarity of the drawing, only two openings are identified by reference character 178. These openings 178 can for example be fashioned as intermediate spaces between the web-type raised parts, or as recesses on inner circumference 179 of fastening sleeve 170.

According to a specific embodiment, fastening sleeve 170 has an outer circumference 173 that, at an annular shoulder 172, tapers into a reduced region 176 oriented away from the tool housing 105. In this reduced region 176, on outer circumference 173 there is provided at least one, and preferably a large number, of plate-shaped control elements. In the illustration, these are fashioned as right-angled trapezoids, each having an associated beveled guide edge. For simplicity and clarity of the drawing, only two control elements are identified by reference character 174, and only two guide edges are identified by reference character 175.

Figure 2:
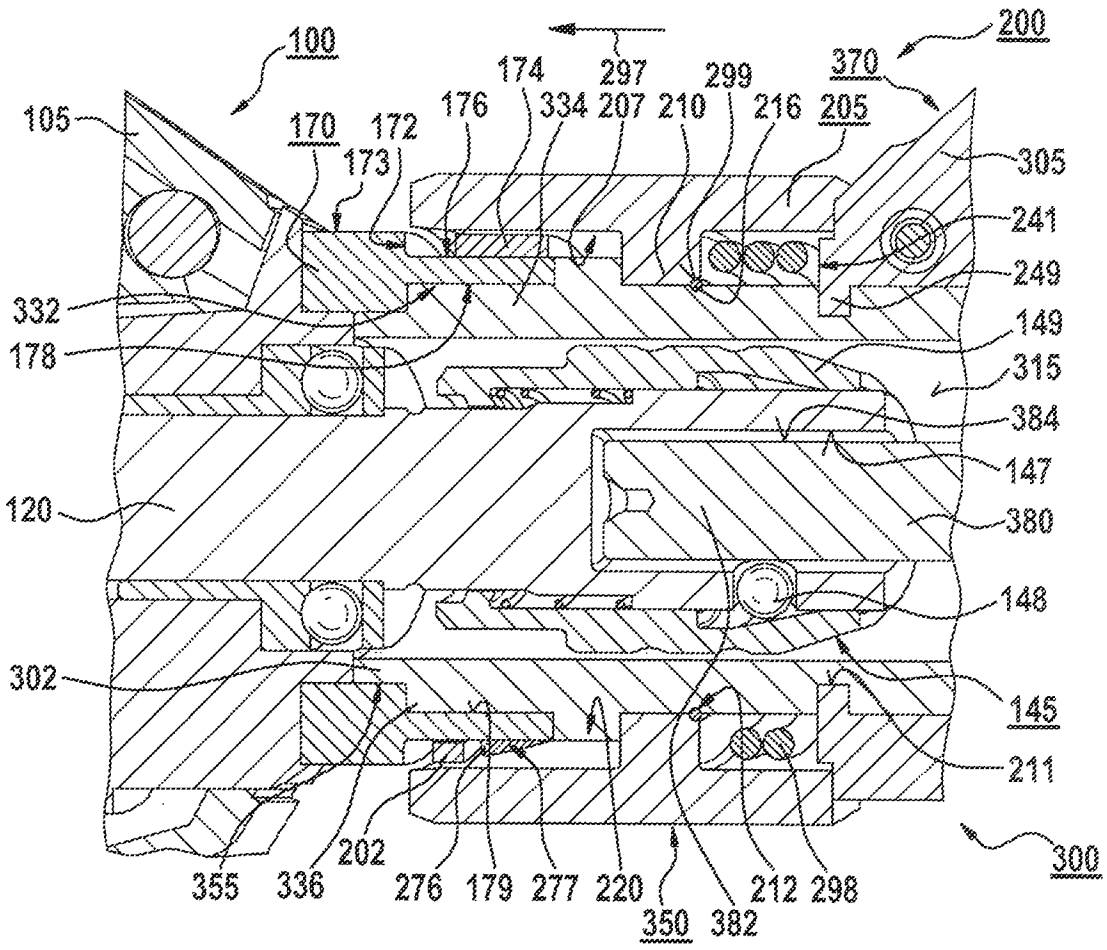
FIG. 2 shows a sectional view of a segment of a tool system having the handheld power tool of FIG. 1, and a tool attachment fastened thereon, according to a first specific embodiment.

FIG. 2 shows an example of a tool system 200 that includes handheld power tool 100 of FIG. 1, having tool housing 105, bit holder 145, and fastening sleeve 170, and a tool attachment 300 that can be fastened thereon and in the example is fastened thereon. Fastening sleeve 170 of handheld power tool 100 has on its outer circumference 173, in the illustration, the plate-shaped control element 174 of the example, as well as a further exemplary plate-shaped control element 276, which in the example has a guide edge 277. A complete description of fastening interface 170 can be found in published German patent application document DE 10 2011 084 499 A1, whose disclosure is explicitly incorporated into the present description, so that a detailed description thereof is omitted here for the sake of brevity.

According to a specific embodiment, tool attachment 300 has a driven unit 370 situated in an attachment housing 305, and a locking unit 350, situated on attachment housing 305, for locking, preferably rotationally securely, tool attachment 300 on fastening sleeve 170 of handheld power tool 100. Driven unit 370 is shown only partly, and is therefore not described further here, for simplicity and clarity of the drawing in FIG. 2. However, driven unit 370 is described in more detail in relation to FIG. 3, where it is shown completely.

Attachment housing 305 can have a one-piece or a multi-piece construction. In addition, attachment housing 305 can also be made up of a plurality of individual housings, or can have a plurality of individual housings connected to one another.

In the illustration, locking unit 350 has a basic body 302, connected to attachment housing 305, in which a drive member 380 of tool attachment 300 is mounted so as to be capable of rotation. Drive member 380 is shown as a drive shaft in the specific embodiment according to FIG. 3. This basic body 302 has, in the illustration, on its outer circumference 355 an annular groove 211 in which a radially inward-pointing annular collar 249 of attachment housing 305 is fixed in such a way that attachment housing 305 is fastened on basic body 302 so as to be at least axially immovable.

Basic body 302 forms a receptacle region 315 in the form of an inner hollow space that receives bit holder 145, provided with at least one locking element 148 and an actuating sleeve 149. On its outer circumference 355, on the one hand a rotational securing unit 332 is fashioned, and on the other hand a locking sleeve 205 is situated so as to be capable of rotational motion and, preferably, axially non-displaceable. Rotational securing unit 332 is fashioned for the fastening, preferably in rotationally secure fashion, of basic body 302 on fastening sleeve 170 of handheld power tool 100. Locking sleeve 205 is used to release or block at least one allocated locking element 202 that in the illustration is fashioned as a blocking web, oriented in the circumferential direction of locking sleeve 205, on inner circumference 207 of locking sleeve 205.

According to a specific embodiment, rotational securing unit 332 is fashioned in an axial end region, facing tool housing 105 of handheld power tool 100, of outer circumference 355 of basic body 302, in such a way that rotational securing unit 332 and fastening sleeve 170 of handheld power tool 100 have complementary geometrical shapes that are suitable for forming a positive-fit connection, and correspondingly are fashioned to engage with one another for the detachable, preferably rotationally secured, fastening of basic body 302 on fastening sleeve 170. Correspondingly, rotational securing unit 332 has in the illustration at least one web-type raised area that extends on outer circumference 355 in the longitudinal direction of basic body 302, two such raised parts 334, 336 being visible in FIG. 2 as examples. Between these web-type raised parts 334, 346 there are fashioned for example groove-type openings, preferably as intermediate spaces between web-type raised parts 334, 336, or as recesses on outer circumference 335. In the illustration, the web-type raised parts 334, 336 and these groove-type openings extend up to an annular projection 220 fashioned on the outer circumference 355, against whose side facing away from tool housing 105 there lies an annular shoulder 210 that is fashioned on inner circumference 207 of locking sleeve 205.

Annular shoulder 210 is situated, in at least substantially axially immovable fashion, on outer circumference 355 of basic body 302 between annular projection 220 and a securing ring 216 that in the illustration is situated in an annular groove 212 of basic body 302. In the area of securing ring 216, annular shoulder 210 has as an example a beveled edge 299. Between annular shoulder 210 and an end face 241 of attachment housing 305 facing handheld power tool 100 there is situated as an example a spring element 298, e.g. a torsion spring. This spring is preferably fashioned to load locking sleeve 205 with a specified spring force, in the direction of an arrow 297, into a locking position in order to form the detachable, preferably rotationally secured, fastening of basic body 302 on fastening sleeve 170, the locking position corresponding to a first rotational position of locking sleeve 205.

For the fastening of tool attachment 300 on fastening sleeve 170 of handheld power tool 100, its basic body 302 is pushed onto fastening sleeve 170 in the direction of arrow 297, so that drive shaft 380 of tool attachment 300 is pushed into bit holder 145 with a positive fit and can be rotationally driven thereby with a positive fit. For this purpose, drive shaft 380 has a free end 382 provided with a polygonal entraining contour 384. For the positive-fit accommodation of polygonal entraining contour 384 in polygonal inner receptacle 147, polygonal entraining contour 384 and polygonal inner receptacle 147 are made with corresponding shapes. Basic body 302, and thus tool attachment 300, are here detachably locked on fastening sleeve 170 of handheld power tool 100, without requiring for this purpose a manual rotation of locking sleeve 205 by a user. Thus, the mounting of tool attachment 300 on handheld power tool 100 can easily be accomplished by the user using one hand. In addition, basic body 302 is preferably fixed and centered in rotationally secured fashion on fastening sleeve 170 by rotational securing unit 332 for torque support. However, it is to be noted that the fastening of tool attachment 300 on fastening sleeve 170 is not a component of the present invention, so that, for the sake of brevity of the description, a detailed description thereof can be omitted.

However, it is to be noted that the above description of the fastening, which is axially immovable, at least within specified tolerances, and is preferably rotationally secured, of locking unit 350 on the fastening sleeve or fastening interface 170 is given only as an example and is not to be understood as a limitation of the present invention. Rather, a large number of different types of fastening, also known from the existing art, may be used, by which an e.g. rotationally secure fastening of a corresponding tool attachment on handheld power tool 100 can be enabled. Here, both rotational fastening devices, such as bayonet joints, and also spring-loaded fastening devices, etc., may be used.

Figure 3:
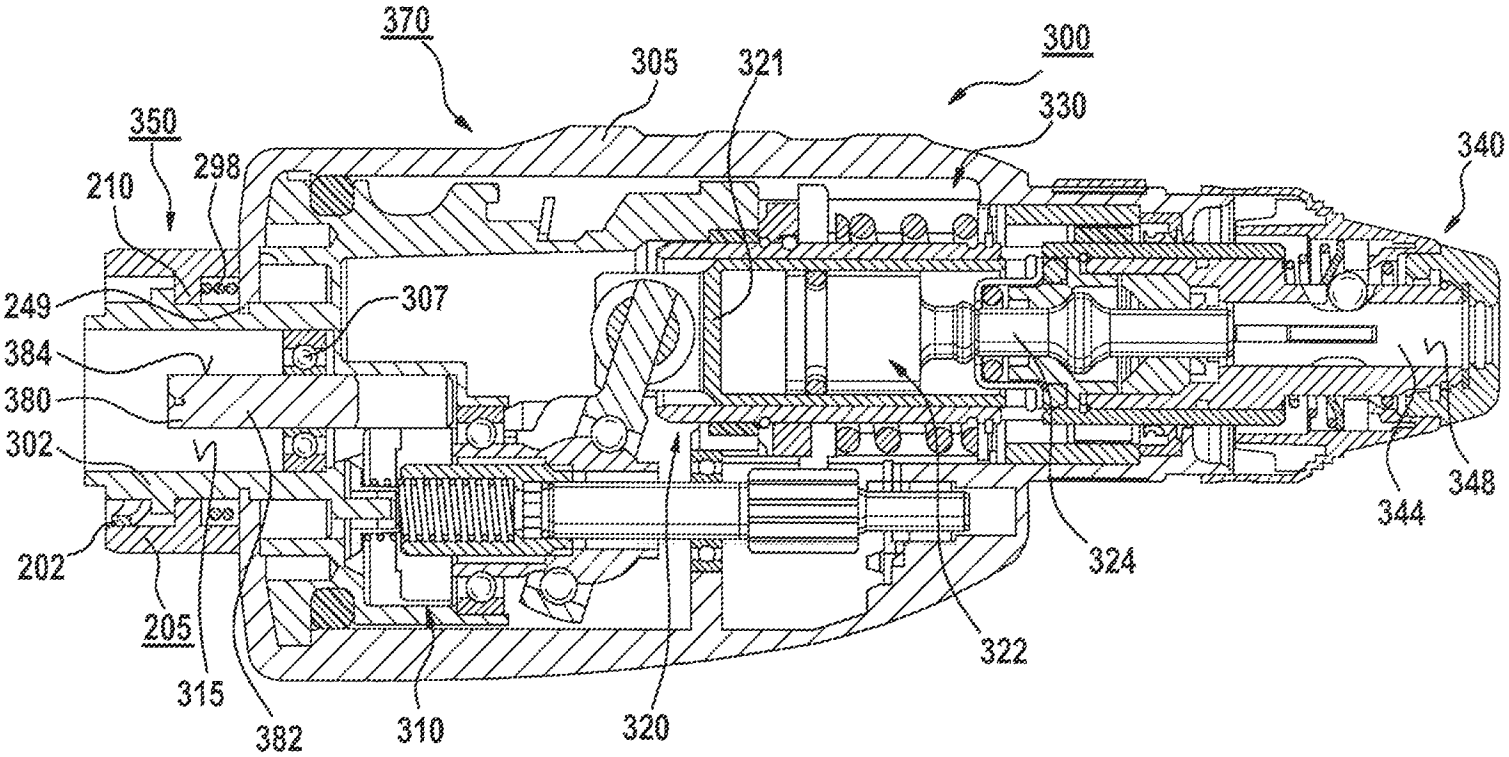
FIG. 3 shows a sectional view of the tool attachment of FIG. 2.

FIG. 3 shows tool attachment 300 of FIG. 2, with driven unit 370 situated in attachment housing 305 and locking unit 350. At an axial end of attachment housing 305 facing away from locking unit 350, there is preferably situated a tool receptacle 340 provided with a driven element 344 for accommodating an insertion tool (e.g. insertion tool 150 of FIG. 1). In the illustration, a driven element 344 is fashioned as a locking sleeve or tool mount, and is provided with an inner receptacle 348. According to a specific embodiment, this is fashioned to accommodate SDS-plus and/or SDS-quick insertion tools. In addition or alternatively, inner receptacle 348 can also be fashioned to accommodate round-shaft insertion tools and/or hex insertion tools.

According to a specific embodiment, driven unit 370 is driven by drive shaft 380, which is rotatably mounted in basic body 302 of locking unit 350 via an allocated bearing element 307, e.g. a roller bearing, the basic body being connected to attachment housing 305 in axially immovable fashion, as described in relation to FIG. 2. Preferably, drive shaft 380 is situated for the rotational driving of driven element 344, as well as for the driving of a hammer mechanism 320 situated in attachment housing 305, the hammer mechanism being fashioned to charge an insertion tool (e.g. insertion tool 150 of FIG. 1) situated in tool receptacle 340 with impacts executed in the axial direction of tool receptacle 340 during operation of tool attachment 300. In order to produce an impact force that is required in particular for drilling in hard stone or concrete, a gear mechanism 310 is preferably connected between drive shaft 380 and hammer mechanism 320, the gear mechanism preferably being fashioned as a step-up gear mechanism. Alternatively, gear mechanism 310 can also be fashioned as a step-down gear mechanism.

According to a first specific embodiment, hammer mechanism 320 is fashioned as a pneumatic hammer mechanism, and has a beater 322 that, during operation of tool attachment 300, is driven by a piston 321 so as to impact against an impact bolt 324 that is connected to driven element 344. Piston 321 is driven at least indirectly by gear mechanism 310. Between piston 321 and beater 322, here air acts as a spring, in the case in which hammer mechanism 320 is fashioned as a pneumatic hammer mechanism. In addition, hammer mechanism 320 has as an example an overload clutch 330.

However, it is to be noted that the design and functioning of a pneumatic hammer mechanism is adequately known to those skilled in the art. For example, the pneumatic hammer mechanism can be fashioned as a pneumatic hammer mechanism as standardly used in drilling hammers. Therefore, for the sake of brevity of the description, a detailed description of the pneumatic hammer mechanism is omitted.

Figure 4:
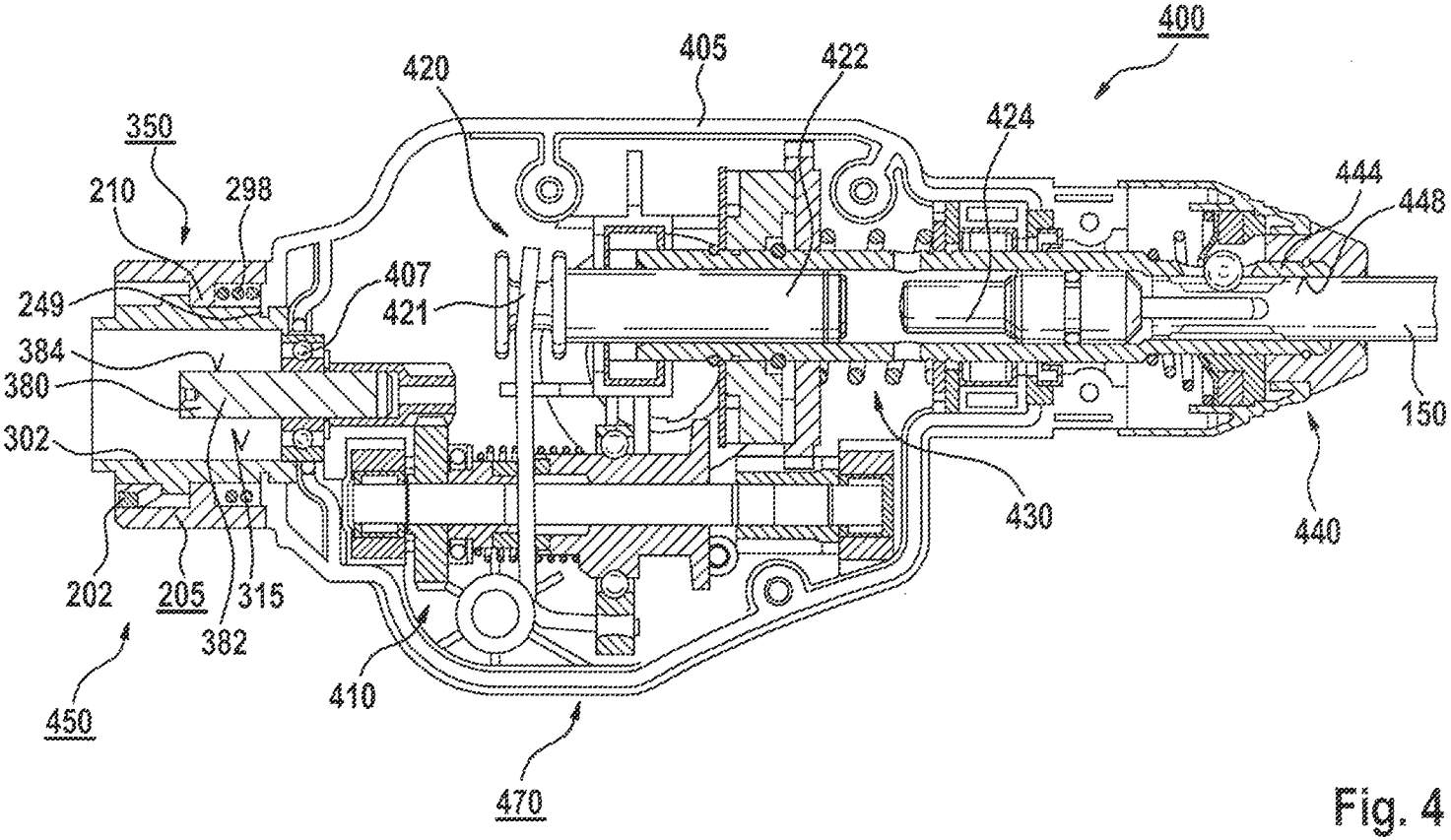
FIG. 4 shows a sectional view of a tool attachment according to a second specific embodiment.

FIG. 4 shows a tool attachment 400 according to a second specific embodiment, having a driven unit 470 situated in attachment housing 405 and a locking unit 450. Locking unit 450 is for example realized by locking unit 350 of tool attachment 300 of FIGS. 2 and 3, so that tool attachment 400, instead of tool attachment 300 of FIGS. 2 and 3, is used with handheld power tool 100 of FIG. 1, and for this purpose can be fastened on fastening sleeve 170 thereof.

On an axial end, facing away from locking unit 350, of attachment housing 405, there is preferably situated a tool receptacle 440, provided with a driven element 444, for accepting an insertion tool, e.g. insertion tool 150 of FIG. 1. In the illustration, driven element 444 is fashioned as a locking sleeve or tool mount, and is provided with an inner receptacle 448. According to a specific embodiment, this inner receptacle is fashioned to accept SDS-plus and/or SDS-quick insertion tools. In addition or alternatively, inner receptacle 448 can also be fashioned to accept round-shaft insertion tools and/or hex insertion tools.

Driven unit 470 is driven by drive element 380, fashioned as a drive shaft, which is rotatably mounted, via an allocated bearing element 407, e.g. a roller bearing, in basic body 302 of locking unit 350, which body is here connected axially immovably to attachment housing 405. Preferably, drive shaft 380 is situated for the rotational drive of driven element 444 and for driving a hammer mechanism 420 situated in attachment housing 405, the hammer mechanism being fashioned to charge insertion tool 150 situated in tool receptacle 440 with impacts executed in the axial direction of tool receptacle 440 during operation of tool attachment 400. In order here to produce a hammer force required in particular for drilling in hard stone or concrete, a gear mechanism 410 is preferably connected between drive shaft 380 and hammer mechanism 420, the gear mechanism preferably being fashioned as a step-up gear mechanism. Alternatively, gear mechanism 410 can also be fashioned as a step-down gear mechanism.

According to the second specific embodiment, hammer mechanism 420 is fashioned as a mechanical hammer mechanism, and has a beater 422 that, during operation of tool attachment 400, is driven by a drive spring 421 so as to impact against an impact bolt 424 that is connected to driven element 444. Drive spring 421 is driven at least indirectly by gear mechanism 410. In addition, hammer mechanism 420 has as an example an overload clutch 430.

However, it is to be noted that the design and functioning of pneumatic hammer mechanism 420 are also adequately known to those skilled in the art. For example, pneumatic hammer mechanism 420 can be fashioned as a mechanical hammer mechanism as standardly used in drilling hammers. Therefore, for the sake of brevity of the description, a detailed description of mechanical hammer mechanism 420 is omitted.

Figure 5:
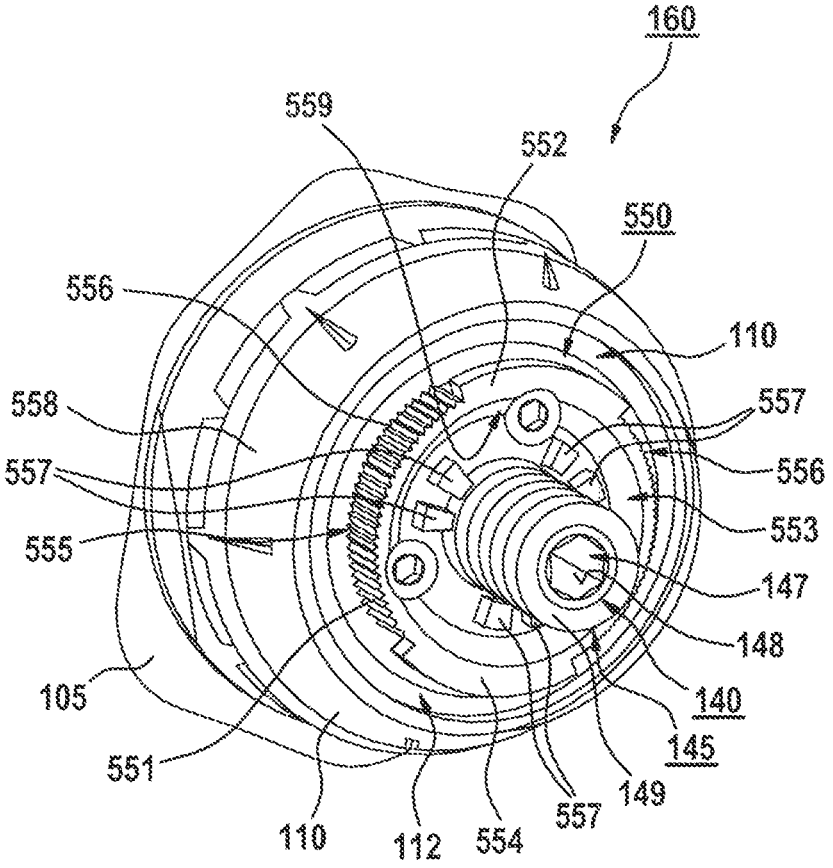
FIG. 5 shows a perspective view of a tool receptacle and of a fastening interface of the handheld power tool of FIG. 1 according to a second specific embodiment.

FIG. 5 shows detail 160 of handheld power tool 100 of FIG. 1 with tool receptacle 140, having for example bit holder 145, as well as having a fastening interface 550, also referred to below as "machine interface," according to an alternative specific embodiment. In a manner similar to that shown for the specific embodiment according to FIG. 2, bit holder 145 has a polygonal inner receptacle 147, in particular a hexagonal inner receptacle 147. Bit holder 145 has a locking element 148 that can be actuated by an actuating sleeve 149. Machine interface 550 is, in the illustration, fastened so as to be axially and radially immovable in the region of bit holder 145 on tool housing 105 and/or on gear mechanism housing 110 of handheld power tool 100 of FIG. 1. However, it is to be noted that machine interface 550 is fashioned as a separate component only as an example, and alternatively can also be fashioned in one piece with tool housing 105 and/or gear mechanism housing 110.

Figure 6:
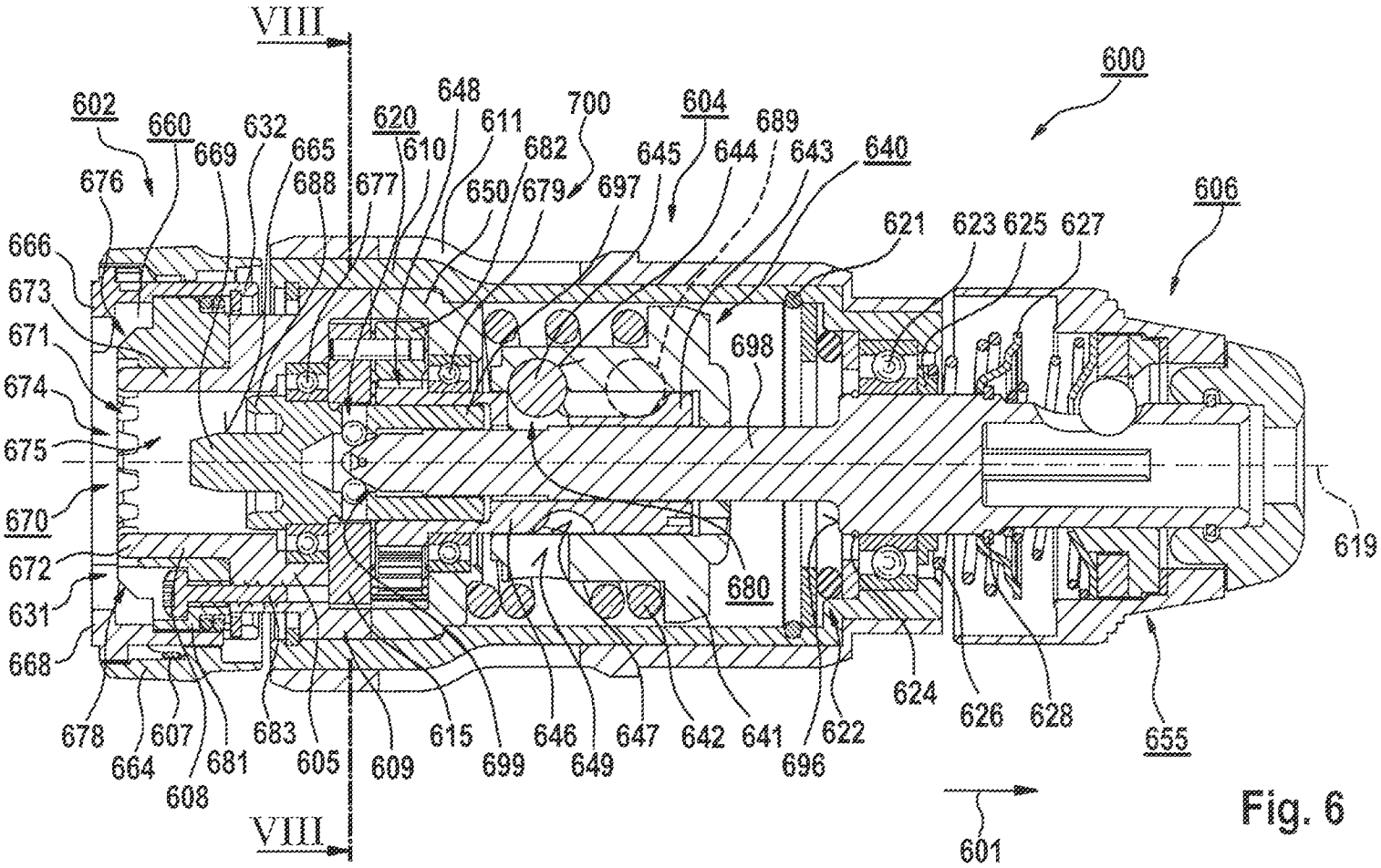
FIG. 6 shows a sectional view of a tool attachment according to a third specific embodiment.

Machine interface 550 is used for the preferably rotationally secure fastening of an allocated tool attachment (600 in FIG. 6), which can be fashioned for example as a so-called in-line attachment, drill chuck attachment, angular or eccentric attachment, and preferably has a hammer mechanism (640 in FIG. 6). In the illustration, machine interface 550 has a fastening element 551 fastened in rotationally secure fashion on an end face 112 of tool housing 105, on this housing and/or on gearing housing 110. This fastening element is for example made as a sleeve or ring in at least some segments, and in the region of a torque setting sleeve 558 situated in annular fashion on end face 112 on tool housing 105 and allocated to optional torque coupling 199 is fastened with suitable fastening elements, e.g. screws or rivets, but alternatively can also be made in one piece with tool housing 105 and/or gearing housing 110. Fastening element 551 sheaths bit holder 145 preferably at least in some segments with a specified radial spacing in order to enable an axial displacement of locking sleeve 149 of bit holder 145 inside fastening element 551.

According to a specific embodiment, fastening element 551 has on its outer circumference at least one blocking element 555 and at least two holding elements 552, 554. Blocking element 555 preferably has at least one blocking toothing 556, and the at least two holding elements 552, 554 are for example fashioned as bayonets in order to form a bayonet joint. However, it is to be noted that the description of such a bayonet joint is provided only as an example and is not a limitation of the present invention. Rather, alternative fastening possibilities can also be used for machine interface 550, in which a corresponding tool attachment (600 in FIG. 6) can be fastened to machine interface 550 via a rotational movement, e.g. a so-called wire bracket locking, etc.

In the illustration, on machine interface 550 a centering aid 553, which is cone-shaped at least in some segments, is provided for the axial centering of a locking unit (602 in FIG. 6) of an allocated tool attachment (600 in FIG. 6), fastening element 551 being fashioned to enable the axial centering of the allocated tool attachment (600 in FIG. 6) on tool housing 105 and/or on gear mechanism housing 110. For this purpose, on the inner circumference of fastening element 551 there is provided a for example annular, funnel-shaped in at least some segments, centering surface 559 forming centering aid 553.

However, it is to be noted that centering surface 559 is shown with a funnel shape only as an example, and not as a limitation of the present invention. Rather, a conical realization on an additional centering ring can also be realized. Correspondingly, a reference to the term "cone-shaped" in the context of the present invention represents a reference both to a conical and to a funnel-shaped realization of a corresponding component. In addition, centering aid 553 can have, instead of a single annular and funnel-shaped centering surface 559, a plurality of cone-shaped bent segments, etc.

In addition, fastening element 551 has at least one, and as an example three, optional angle adjustment elements 557. For example in the case of a fastening of a tool attachment formed as an angular or eccentric attachment on machine interface 550, these elements are used to specify a particular angular position.

FIG. 6 shows a tool attachment 600 according to a third specific embodiment fashioned for fastening on machine interface 550 of FIG. 5. Tool attachment 600 has for example a fastening interface 602, designated in the following as "attachment interface" for the sake of clarity of the description, a drive unit 604, also referred to as "drive segment" below, and a tool receptacle 606, also referred to below as "receptacle segment." Here, in the illustration these have an SDS-plus or SDS-quick receptacle 655, but can also have any other receptacle, e.g. a round-shaft chuck, etc. Drive unit 604 has for example a hammer mechanism 640 fashioned as a mechanical hammer mechanism. Therefore, in order to simplify the description tool attachment 600 is also referred to as "hammer mechanism attachment 600."

Drive segment 604 has an example an attachment housing 610 that preferably has an external, e.g. rubberized, handle region 611. In attachment housing 610, a drive element 697, allocated to hammer mechanism 640 and capable of being driven rotationally, is rotationally mounted in a first bearing element 677. Drive element 697 is preferably situated coaxially to receptacle segment 606, and is used to drive a driven element 698, e.g. via an at least positive-fit connection, driven element 698 also being mounted in rotationally movable fashion in attachment housing 610, for example in a bearing element 623, and can for example be fashioned to accommodate screwdriver bit 150 of FIG. 1. On this driven element 698 there is situated in the region of bearing element 623, on its axial side facing hammer mechanism 640, a securing element 624, preferably a securing ring, in order to prevent driven element 698 from slipping out of attachment housing 610. On the axial side of bearing element 623 facing away from hammer mechanism 640 there is situated a supporting ring 625, for supporting a spring element 626, that lies against a plate-shaped charging element 627 secured by a securing ring 628 in receptacle segment 606. Spring element 626, fashioned as a pressure spring, pretensions receptacle segment 606 and thus driven element 698 in an axial direction pointing away from attachment housing 610, as indicated by an arrow 601.

Preferably, driven element 698 is a driven spindle, allocated to receptacle segment 606 and capable of rotation about an axis of rotation 619, axis of rotation 619 coinciding with a corresponding drive axis of hammer mechanism 640 or a corresponding axis of rotation of the drive element 697. Correspondingly, hammer mechanism 640 is fashioned as a so-called "in-line hammer mechanism" for the immediate impact driving of the driven element or driven spindle 698 during hammer operation of hammer mechanism attachment 600, the driven element, or driven spindle, 698 being fashioned to immediately transmit corresponding impact impulses to insertion tool 150 of FIG. 1 situated therein. Driven element or driven spindle 698 includes an impact surface 696 against which an impact body 641 of hammer mechanism 640 impacts during hammer operation. In order to dampen the impact impulses, or a feedback resulting therefrom to attachment housing 610, and to dampen vibrations transmitted through receptacle segment 606 to attachment housing 610, in attachment housing 610 there is provided a damping element 622 that is fixed in the region of bearing element 623 via a securing element 621, preferably a securing ring.

According to a specific embodiment, hammer mechanism 640 has an impact body 651 that is spring-loaded by a spring element 642 fashioned as a pressure spring, the impact body being coupled to allocated spring tension element 646 via a ball guide 680. Impact body 641 is preferably provided to execute axially oriented impacts, i.e. impacts in the direction of arrow 601, against driven spindle 698. Spring tension element 646 is for example fashioned as a sleeve and is accommodated in impact body 641 with its front axial end 643 facing the impact body, a spherical tension element 645 being situated in the region between spring tension element 646 and impact body 641. This tension element is situated on the one hand in a radial opening 644 of impact body 641, and can on the other hand roll in a control curve 647 fashioned on the inner circumference of spring tension element 646. Radial opening 644 of impact body 641 is fashioned on the inner circumference thereof and can for example be produced via a diametrically oppositely situated through-bore 649, by guiding through a corresponding drilling tool.

The position shown in FIG. 6 of spherical tension element 645 corresponds in the illustration to a tensioned position in which spring element 642 has maximum tension, so that, by releasing tension element 645, an axial impact of impact body 641 against driven spindle 698 is enabled. After such an impact is executed, tension element 645 is in a rest position 689 indicated in broken lines.

On its axial end facing away from impact body 641, spring tension element 646 accommodates drive element 697, spring tension element 646 being rotatably situated on drive element 697 independent thereof. To drive spring tension element 646, preferably a step-up gear mechanism 700 is used that can be activated in hammer operation of hammer mechanism 640, here fashioned in the illustration as a one-stage planetary gear mechanism having a planetary bearer 615 that can be driven by drive element 697 and a plurality of planet gears 682. These are coupled in terms of drive to spring tension element 646 via an entraining toothing 648, and are situated in an allocated hollow gear 650. This hollow gear is situated in attachment housing 610, fixed to the housing and rotationally secured, and has an axial end facing impact body 641 in which there is situated a bearing element 679, e.g. a roller bearing, for the rotational mounting of spring tension element 646, preferably radially and axially immovably, and has an axial end facing away from impact body 641 and facing attachment interface 602, on which end planet gears 682 engage.

According to a specific embodiment, for the activation of hammer operation of hammer mechanism 640 there is provided an engaging clutch 620, which can preferably be actuated through an axial displacement of driven spindle 698 against the spring force of spring element 626, acting as no-load spring, and opposite the direction of arrow 601. This engaging clutch is preferably fashioned to enable, when there is an actuation by driven spindle 698 (shown in an associated no-load position in FIG. 6), a driving of spring tension element 646 by step-up gear mechanism 700 in order to tension and release spring element 642 via impact body 641. In order here to enable an actuation of engaging clutch 620 by driven spindle 698, the driven spindle preferably has a cone-shaped axial end 699 situated in drive element 697 and provided for engagement with engaging clutch 620 during hammer operation of hammer mechanism 640.

The functioning of engaging clutch 620 is described below in relation to FIG. 7. The functioning of hammer mechanism 640, as well as further details concerning components thereof, are described in German patent application document DE 10 2013 208 882.5, whose disclosure is explicitly incorporated into the present description, so that a detailed description thereof can be omitted here for the sake of brevity of the description.

Drive element 697 has a free end 669 facing away from drive segment 604, on which there is advantageously fashioned a polygonal entraining contour 665, in particular a hexagonal entraining contour. Polygonal entraining contour 665 is fashioned corresponding to polygonal inner receptacle 147 of tool receptacle 140. Polygonal entraining contour 665 is provided to be rotationally driven by polygonal inner receptacle 147 of handheld power tool 100.

On free end 669 there is situated an angular adjustment element 672 that is fashioned as a sleeve or tube in at least some segments, through which drive element 697 passes at least in some segments. The angular adjustment element has a basic body 673. Basic body 673 is preferably connected rigidly, i.e. axially and radially immovably, to attachment housing 610, and/or is fashioned in one piece therewith. In the illustration, basic body 673 has on its axial end facing drive segment 604 an outer annular collar 609 that is situated axially and radially immovably in the attachment housing 610, e.g. by pressing in or clamping, and that lies axially against hollow gear 650. This annular collar 609 is preferably fashioned on its inner circumference as a receptacle for planetary bearer 615. On its other axial end 671, an end-face angular adjustment toothing 674 is provided. Between outer annular collar 609 and angular adjustment toothing 674, basic body 673 has a sleeve-shaped segment 608 that forms a receptacle region 675, in the form of an inner hollow space, for accommodating bit holder 145, provided with at least one locking element 148 and an actuating sleeve 149, of tool receptacle 140.

In addition, drive element 697 forms an actuating element 688 that surrounds drive element 697 as a sleeve in at least some segments and that is fashioned for the loading of locking sleeve 149 of FIG. 5. Alternatively, drive element 697 and actuating element 688 can also be fashioned with a two-piece or multi-piece construction. Actuating element 688 is for example situated in the interior of angular adjustment element 672, and is preferably situated radially at a distance therefrom.

Attachment interface 602 is used to fasten hammer mechanism attachment 600 to an allocated handheld power tool, e.g. handheld power tool 100 of FIG. 1, or machine interface 550 thereof shown in FIG. 5, and in the illustration has an angular position adjustment unit 670 that is allocated to angular adjustment element 672, as well as a locking unit 660. Locking unit 660 is fashioned to, in a locked state, lock hammer mechanism attachment 600 in a specified angular position on the handheld power tool for the operation thereof, and, in an unlocked state, to enable hammer mechanism attachment 600 to be removed from the handheld power tool. Angular position adjustment unit 670 is fashioned to enable an adjustment of the specified angular position of hammer mechanism attachment 600 for operation on the handheld power tool. Here, according to a specific embodiment angular position adjustment unit 670 can be actuated in the locked state of locking unit 660 in order to enable a change in the specified angular position. Such an actuation for changing the specified angular position preferably takes place through a combined longitudinal and rotational motion of attachment housing 610.

According to a specific embodiment, locking unit 660 has a locking body 632 and a spring-loaded centering body 681 mounted rotationally in the locking body. This centering body 681 is fastened, by suitable fastening elements 683, e.g. screws, in rotationally secure fashion on an axial end collar 605 of angular adjustment element 672, in which bearing element 677 is situated. On an axial end of centering body 681 facing away from drive segment 604, this centering body has at least one centering element 631 that e.g. has at least two curved centering regions 676, 678 that are beveled in the longitudinal direction of hammer mechanism attachment 600, i.e. opposite direction 601. However, it is to be noted that centering element 631 has the at least two curved and beveled centering regions 676, 678 only as an example, and not as a limitation of the present invention. Centering element 631 can rather also have a single centering region formed as a frustum.

Locking body 632 preferably has at least two locking elements 666, 668 that for example are fashioned as bayonets in order to form a bayonet joint. In addition, on the outer circumference of this locking body 632, as an example an actuating ring 664 is situated that can be actuated in order to lock locking body 632 on the handheld power tool; here locking body 632 and actuating ring 664 can be fashioned in one piece.

In the region between locking body 632 and actuating ring 664, there is preferably situated an optional blocking element 607 that is flexible at least in some regions. This element is positionally fixed at least in some segments on locking body 632 and/or on actuating ring 664, and is fashioned to prevent, in the locked state of locking unit 660, a rotation of locking body 632 from its locked position to its unlocked position, locking and blocking element 607 preferably working together with blocking element 555 of FIG. 5 allocated to machine interface 550 of FIG. 5. Here, actuating ring 664 is preferably fashioned to charge, in the locked state of locking unit 660, locking and blocking element 607 at least in some segments against machine interface 550 of FIG. 5. Locking and blocking element 607 is here fashioned to block actuating ring 664, in the locked state of locking unit 660, in a blocking position on locking body 632, in which actuating ring 664 at least in some segments loads locking and blocking element 607 against machine interface 550 of FIG. 5 in order to prevent an automatic rotation of actuating ring 664 relative to locking body 632.

Figure 7:
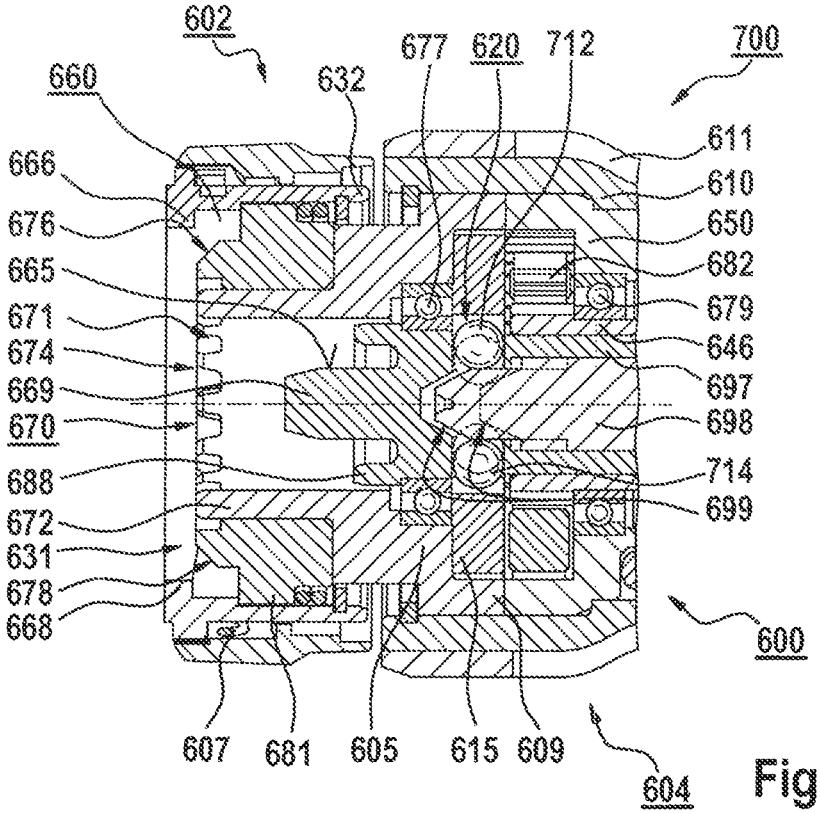
FIG. 7 shows a detail of FIG. 6.

FIG. 7 shows a detail of hammer mechanism attachment 600 of FIG. 6 in order to illustrate step-up gear mechanism 700 and engaging clutch 620. This coupling has at least one, and preferably a plurality of, in the illustration four, coupling elements 712, 714 (and 812, 814 in FIG. 8) that are situated in allocated openings of drive element 697 and can here be radially inwardly loaded by an optional tensioning element, e.g. an O-ring or suitable pressure springs. Coupling elements 712, 714 are here shown as an example in their radially outward coupling positions in which they connect drive element 697 in rotationally fixed fashion to planetary bearer 615, so that step-up gear mechanism 700 is activated, and spring tensioning element 646 is thus driven faster by the speed transformation thereof than is driven spindle 698.

In addition, FIG. 7 shows the spherical coupling elements 712, 714 in their radially inner no-load positions, shown in dashed or transparent fashion, in which coupling elements 712, 714 are positioned further radially inward compared to their coupling positions. From these no-load positions, spherical coupling elements 712, 714 can move, under loading by cone-shaped axial end 699 of driven spindle 698, into their coupling positions, and can be held there by driven spindle 698. This is achieved through the axial displacement, described in relation to FIG. 6, of driven spindle 698 against the spring force applied by no-load spring 626 of FIG. 6; here, when there is a release of driven spindle 698 this spindle is moved or pressed back into its no-load position by no-load spring 626 of FIG. 6.

Figure 8:
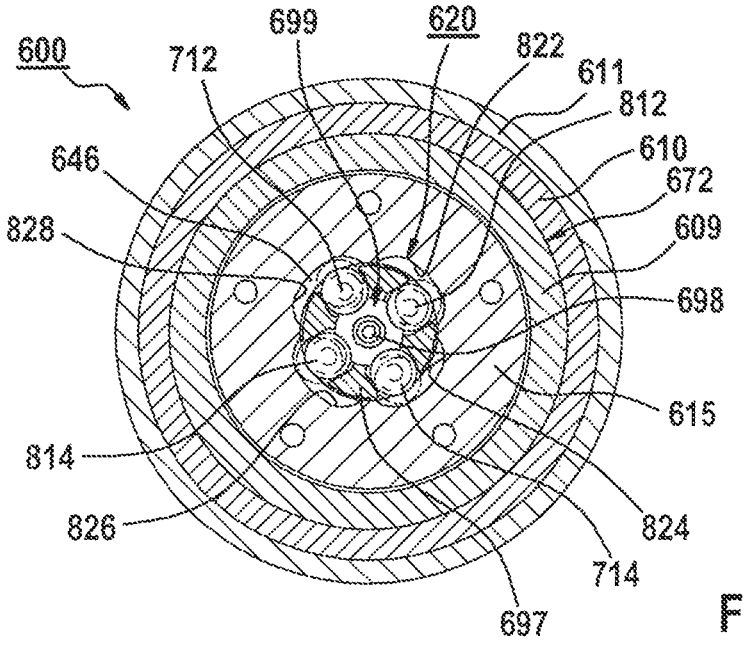
FIG. 8 shows a sectional view of the tool attachment of FIG. 6, seen in the direction of a sectional line VIII-VIII in FIG. 6.

FIG. 8 shows engaging clutch 620 of hammer mechanism attachment 600 of FIGS. 6 and 7 in order to illustrate spherical coupling elements 712, 714, as well as two further spherical coupling elements 812, 814. These are shown on the one hand in their no-load positions, and are additionally indicated, in dashed form, in their coupling positions, in which they engage with some segments in drive element 697 and with some segments in allocated dome-shaped openings 828, 824, 822, or 826 of planetary bearer 615.

Fastening interface 170 according to FIG. 1 and fastening interface 550 according to FIG. 5 have each been selected as examples. For example, fastening interface 170 can alternatively also be used for the fastening of hammer mechanism attachment 600, and fastening interface 550 can alternatively also be used for the fastening of hammer mechanism attachments 300 or 400. Fastening interfaces 170, 550 are fashioned to bring about an axial securing as well as a rotational securing of tool attachment 300, 400, 600 on a stationary housing component, in particular tool housing 105 and/or gear mechanism housing 110, of handheld power tool 100.

Alternative specific embodiments of the fastening interface and of the securing elements for axial securing and securing elements for rotational securing are possible. An alternative fastening interface having the corresponding securing elements is for example described in published German patent application document DE 10 2011 084 495 A1, whose disclosure is explicitly incorporated into the present description, so that here a detailed description thereof can be omitted in the interest of brevity of the description. Further alternative securing elements are also possible. Thus, for example as axial securing element it is also possible to use a tension element, for example a tension lever, on the tool attachment that interacts with a circumferential groove on the housing of the handheld power tool. In a further alternative specific embodiment of a locking of a tool attachment on a handheld power tool, securing elements are fashioned for rotational securing on a stationary housing component such as the tool housing and/or the gear mechanism housing. The rotational securing elements can for example be locking projections for which corresponding locking openings are provided on the tool attachment. Securing elements for axial securing are in contrast provided on the driven spindle or bit holder of the handheld power tool. As axial securing element, here a circumferential groove can be present on the circumferential surface of the bit holder. Correspondingly, at least one locking body, for example a locking ball, that works together with the groove is situated on the tool attachment. For locking, the locking body engages in the groove on the bit holder.

What is claimed is:

1. A tool attachment for a handheld power tool having a housing with a fastening interface opening, wherein the tool attachment is detachably locked on the fastening interface opening of the handheld power tool, the tool attachment comprising:

an attachment housing;

a locking unit situated on the attachment housing for locking the tool attachment on the fastening interface of the handheld power tool;

a tool receptacle accommodating an insertion tool; and a hammer mechanism situated in the attachment housing and configured to apply an impact in the axial direction of the tool receptacle on the insertion tool during hammer operation of the tool attachment.

2. The tool attachment as recited in claim 1, wherein the hammer mechanism is a pneumatic hammer mechanism.

3. The tool attachment as recited in claim 1, wherein the hammer mechanism has a beater which, during operation of the tool attachment, is driven by a piston allocated to the beater, to impact against an impact bolt.

4. The tool attachment as recited in claim 3, wherein the impact bolt is connected to a driven element allocated to the tool receptacle.

5. The tool attachment as recited in claim 1, wherein the hammer mechanism is a mechanical hammer mechanism.

6. The tool attachment as recited in claim 5, wherein the hammer mechanism has a drive element situated coaxially to the tool receptacle.

7. The tool attachment as recited in claim 5, wherein the tool receptacle has a driven spindle rotatable about a specified axis of rotation which coincides with a drive axis of the hammer mechanism.

8. The tool attachment as recited in claim 6, wherein the drive element has a free end on which a polygonal entrainment contour is provided.

9. The tool attachment as recited in claim 5, wherein the hammer mechanism is configured for immediate impact driving of a driven element allocated to the tool receptacle during hammer operation of the tool attachment, the driven element being configured to transmit corresponding impact impulses immediately to the insertion tool.

10. The tool attachment as recited in claim 5, wherein the hammer mechanism has an impact body which is spring-loaded by a spring element, the impact body being coupled to an allocated spring tension element via a ball guide.

11. The tool attachment as recited in claim 10, wherein the hammer mechanism has an engaging clutch selectively actuated in order to activate the hammer operation of the hammer mechanism.

12. The tool attachment as recited in claim 5, wherein a gear mechanism is situated in the attachment housing.

13. The tool attachment as recited in claim 5, further comprising:

a step-up gear mechanism configured to increase a rotational speed for driving the hammer mechanism relative to a rotational speed of a driven element.

14. The tool attachment as recited in claim 5, wherein the tool receptacle is configured to accept at least one of an SDS-plus insertion tool and an SDS-quick insertion tool.

15. The tool attachment as recited in claim 5, wherein the tool receptacle is configured to accept at least one of a round-shaft insertion tools and a hex insertion tool.

16. The tool attachment as recited in claim 5, wherein the tool attachment is configured for positive-fit driving by the handheld power tool.

17. A tool system, comprising:

a handheld power tool including a housing having a fastening interface; and a tool attachment, wherein the tool attachment is detachably locked on the fastening interface of the handheld power tool, the tool attachment having:

an attachment housing;

a locking unit situated on the attachment housing for locking the tool attachment on the fastening interface of the handheld power tool;

a tool receptacle accommodating an insertion tool; and a hammer mechanism situated in the attachment housing and configured to apply an impact in the axial direction of the tool receptacle on the insertion tool during hammer operation of the tool attachment.

18. The tool system as recited in claim 17, wherein the handheld power tool is one of a battery-operated screw driller or a battery-operated screwdriver.

19. The tool system as recited in claim 17, wherein the tool attachment is configured to be driven with a positive fit by the handheld power tool.

20. The tool system as recited in claim 17, wherein:

the handheld power tool has a drive spindle; and the tool receptacle of the tool attachment has a driven spindle, the drive spindle and the driven spindle having, after fastening of the tool attachment on the handheld power tool, a common axis of rotation.

21. A tool attachment for a handheld power tool having a housing with a fastening interface opening, wherein the tool attachment is detachably locked on the fastening interface opening of the handheld power tool, the tool attachment comprising:

an attachment housing;

a locking unit situated on the attachment housing for locking the tool attachment on the fastening interface of the handheld power tool;

a tool receptacle accommodating an insertion tool; and a hammer mechanism situated in the attachment housing and configured to apply an impact in the axial direction of the tool receptacle on the insertion tool during hammer operation of the tool attachment, wherein the hammer mechanism is a mechanical hammer mechanism, wherein the hammer mechanism has an impact body which is spring-loaded by a spring element, the impact body being coupled to an allocated spring tension element via a ball guide, wherein the hammer mechanism has an engaging clutch selectively actuated in order to activate the hammer operation of the hammer mechanism, wherein the engaging clutch is configured to enable, upon actuation, a drive of the spring tension element to tension and release the spring element.

* * * * *